United States Patent [19]

Posacki

[11] Patent Number: 4,936,028

[45] Date of Patent: Jun. 26, 1990

[54] REMOVABLE SOLES FOR SHOES

[76] Inventor: Roman J. Posacki, P.O. Box 199, Thornton, Pa. 19373

[21] Appl. No.: 310,584

[22] Filed: Feb. 15, 1989

[51] Int. Cl.[5] ..... A43B 13/36

[52] U.S. Cl. ..... 36/15

[58] Field of Search ..... 36/12, 15, 100, 101

[56] References Cited

U.S. PATENT DOCUMENTS

| | | | |
|---|---|---|---|
| 1,236,350 | 8/1917 | Pougher | 36/15 |
| 1,640,301 | 8/1927 | Torchia | 36/15 |
| 2,435,668 | 2/1948 | Behringer et al. | 36/15 X |
| 2,930,148 | 3/1960 | Parker | 36/15 |
| 3,019,534 | 2/1962 | Kauffman et al. | 36/15 |
| 3,866,339 | 2/1975 | Latto | 36/15 X |
| 4,542,599 | 9/1985 | Annovi | 36/15 X |
| 4,606,139 | 8/1986 | Silver | 36/15 |

FOREIGN PATENT DOCUMENTS

| | | | |
|---|---|---|---|
| 125350 | 6/1949 | Sweden | 36/15 |

*Primary Examiner*—Donald Watkins

[57] ABSTRACT

A shoe with replaceable outsole, destined for use as a tourist, army, work, etc. shoe. It is basically comprised of an upper portion (the shoe itself) to which the uppersole is permanently attached in some manner, a removable outsole with an interlocking feature on top which engages with the bottom of the uppersole and with a varying bottom portion (depending on the use it is put to) and, a removable set of connector rods.

The uppersole on it's bottom portion has a tread with a set of openings. On the upper portion of the outsole there is a tread with a similar set of openings, fitting exactly into the space between the openings of the uppersole. The two interlock to form a complete sole. Horizontal openings or bushings are placed in straight lines the length of the sole. Removable connector rods are then placed into these openings or bushings, providing a secure attachment for the outsole. Set of lightweight, inexpensive and easy to carry outsoles with many different configurations of the bottom assure good traction in any condition in which the shoe may be worn. Once the outsole is worn out, it is a simple, and inexpensive procedure to replace it.

5 Claims, 3 Drawing Sheets

REMOVABLE SOLES FOR SHOES

BACKGROUND

In many cases the use of the same single pair of shoes can be necessary under many varying conditions. Even if the user knows what kind of terrain and weather conditions can be expected on the trail, it is often very inconvenient to carry several pairs of shoes. For example, at rock climbing or high altitude mountaineering, you can expect terrain with grass, mud, rock, snow and often ice. Presently used shoes with "universal" sole treads cannot meet all requirements. For example they are too high and too heavy for flat road surfaces, but do not provide good traction on icy surfaces.

Furthermore, the soles wear out faster than the upper part of the shoe. Commonly used methods of sole replacement are time consuming and expensive, usually necessitating the purchase of new shoes.

Shoes with easy to replace, removable outsoles can be very useful for tourists, as well as for workers when different surface conditions are expected or soles are worn out after a period of use. Use of this kind of shoe can be especially profitable for the armed forces because of their multi-purpose uses and low repair costs.

There are several different inventions related to shoes with replaceable outsoles. The prior art as best known to the inventor is represented by U.S. Pat. Nos. 3,538,628 (Einstein, 1970), 3,866,339 (Latto, 1975), 4,317,294 (Goodyear, 1982), 4,377,042 (Bauer, 1983), 4,606,139 (Silver, 1986), and 4,667,421 (Rouhani, 1970).

None of the above patents disclose the advantageous features of this invention, ie. really rapid, easy assembly and disassembly together with absolute security of the connection between the removable outsole and the upper portion of the shoe.

BRIEF SUMMARY

The invention relates to replaceable shoe soles. The uppersole is permanently connected to the upper portion of the shoe. The upper tread of the outsole is constructed to interlock with the spaces between a similar tread in the bottom of the uppersole. In the tread of the uppersole, as well as in the upper tread of the outsole are permanently mounted bushings. These bushings are placed in straight lines to make easy insertion of the connector rods possible. This allows for easy placement and replacement of the rods. Because the tread of both soles together make a full filled sole, the uppersole cannot move except in conjunction with the outsole. Even after the connector rods have been removed, the bushings are in continuous straight lines through the entire sole.

After the connector rods are placed into the bushings of the uppersole and the outsole a permanent connection between both soles is made. The connector rods prevent the outsole from disconnecting from the uppersole.

All connector rods are permanently mounted to the front plate. A minimum of one connector rod goes thru the whole length of the assembled soles, and is protected from displacement by a nut at the back end of the shoe. After removing the nut, the set of rods mounted to the plate can easily be removed, allowing the outsole to be changed. The soles can be reconnected by interlocking the outsole with the uppersole, insertion of the rods and the tightening of the nut.

This operation can be done under practically any weather conditions in a minimum amount of time.

Outsoles, all with upper tread constructed to fit exactly into the tread of the uppersole, have a variety of different bottom treads. The shape of the bottom tread can be chosen in accordance with the purpose. The user (for example, a tourist or soldier) has the capability of bringing a few uppersoles along, in accordance with expected conditions of terrain or weather. In the case of work boots, different shapes of soles can be used for different working conditions, as well as soles with protectors. If the outsole becomes worn after a certain time, it can be exchanged for a new one, quickly and at a small cost (typically much less than a whole new pair of boots).

Simple, quick assembly and disassembly, flexible but strong connections, relatively low cost and low weight are strong advantages of the present invention.

DESCRIPTION OF THE PREFERRED EMBODIMENTS

With reference to the drawings, a shoe assembly consisting of an upper portion of the shoe, uppersole 1, outsole 2 and a set of connector rods is disclosed.

Figure 1A:
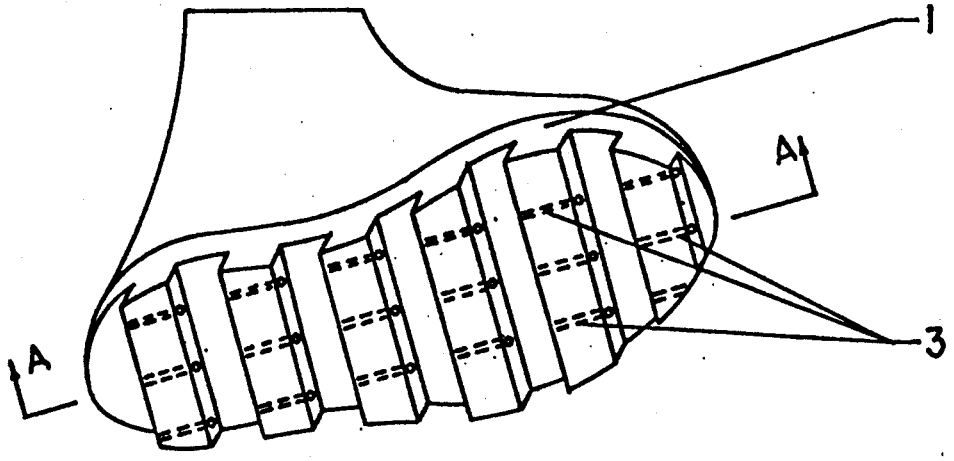
FIG. 1 is an exploded perspective view of a shoe with the uppersole, connector rods mounted to the mounting plate and an outsole. For a better view of the drawing, the shape of the sole's interlocking tread is simplified.
Figure 1B:
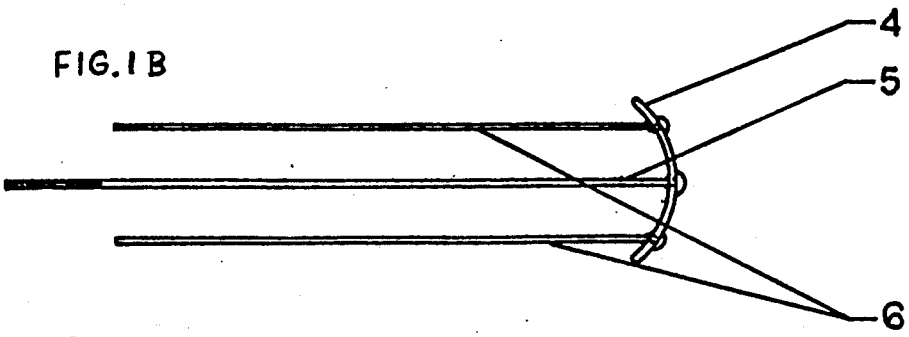
Figure 1C:
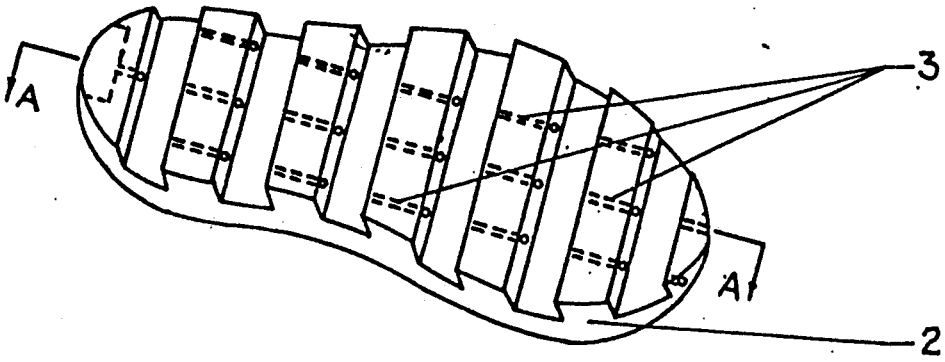

As shown in FIG. 1, the uppersole 1 is permanently connected to the shoe by any convenient, known manner. On the bottom part of the uppersole there is a tread, with a set of bushings 3 placed in straight lines into aforementioned tread. Removable outsole 2 has an upper tread with a set of bushings 3, placed in a similar manner on the same center lines as bushings of uppersole 1. Tread of outsole 2 interlocks with the spaces between the tread of uppersole 1.

The bottom part of outsole 2 has a tread pattern which is determined by the terrain it is used on. When joined, uppersole 1 and outsole 2 make a complete, full sole. The connector rods are placed into bushing 3 of both soles to secure the permanent connection of the assembly and make any movement of the outsole impossible.

The set of connector rods consists of mounting plate 4, to which is permanently connected central rod 5 and set of side rods 6. Removable protectors can be attached to mounting plate 4 (not shown).

Figure 2:
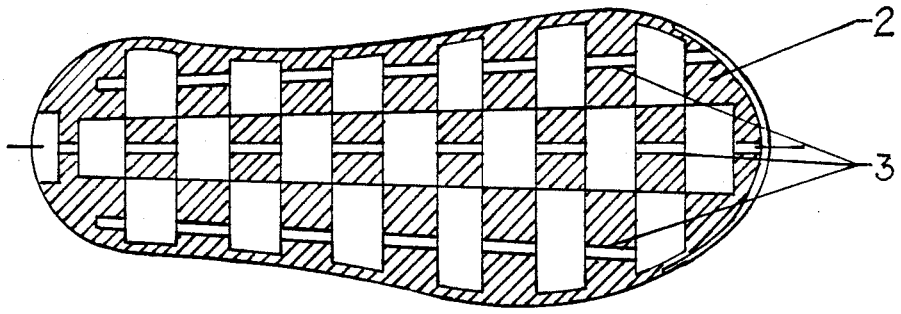
FIG. 2 is a horizontal cross section of the outsole, taken on the plane of the bushings centerlines. The upper tread is shown in the form accorded to the idea of the preferred embodiment.
Figure 3:
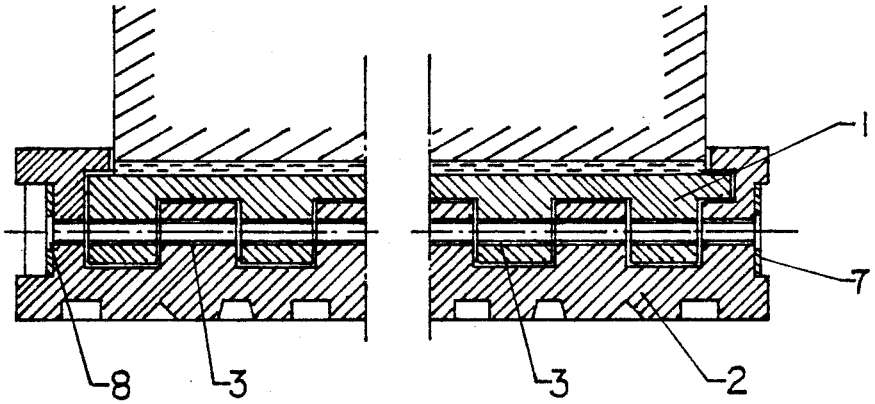
FIG. 3 is an enlarged, fragmentary longitudinal vertical cross section of the shoe with uppersole and outsole placed together, but without the connector rod, taken on line A—A of FIG. 1. The center part of the shoe is omitted—only the front and back ends of the shoe are shown.
Figure 4:
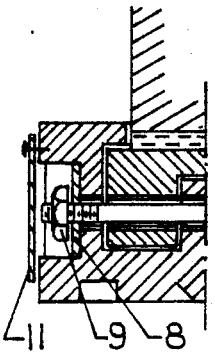
FIG. 4 is a fragmentary vertical cross section of the end of the shoe assembly with uppersole, connector rod and outsole, mounted together by using a nut placed into an indentation in the outsoles material.
Figure 5:
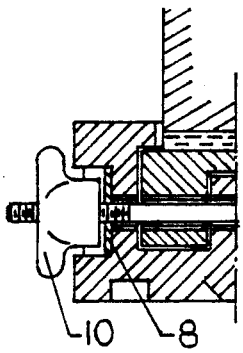
FIG. 5 is a cross section similar to FIG. 4, showing a modified form of assembly's connection—by using a wingnut.
Figure 6:
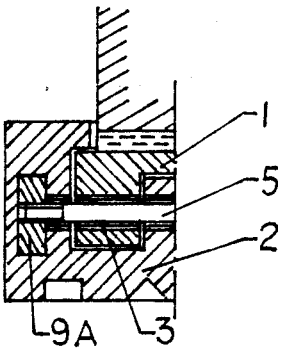
FIG. 6 is a cross section similar to FIG. 4, showing another modification of assembly's connection—a permanently mounted nut in the material of the outsole.

As shown in FIG. 2, the shape of the soles treads are interlocking to prevent unwanted movement.

FIGS. 3–6 show some particular details of the preferred embodiment. On outsole 2, along the length of the upper edge there is a protrusion. This protrusion covers the edge of the upper side of uppersole 1. By this means, debris such as mud or snow cannot get between the treads of the uppersole and the outsole. In the front part of outsole 2 is a small indentation. Mounting plate 4 fits into this indentation. Reinforcement plate 7 can also be used in the indentation as an option. Into the indentation in end part of outsole 2 is pressed reinforcement plate 8. On this plate rests nut 9 or wing nut 10. The nut, screwed onto the threaded end of center connector rod 5, ensures that the whole set of rods with the mounting plate 4 does not slip out of the bushings 3. The indentation in which nut 9 is placed, is protected from debris by plate 11. Optionally, nut 9A can be mounted into the material of any soles in place of the indentation. In this case, central rod 5 screws into the embedded nut.

Figure 7:
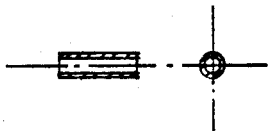
FIG. 7 is an enlarged section of a bushing.
Figure 8:
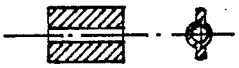
FIG. 8 is a section similar to FIG. 7, showing a reinforced form of the bushing.

Bushing 3, placed into the treads of both soles can be simple, as shown in FIG. 7, or reinforced as shown in FIG. 8.

Figure 9:
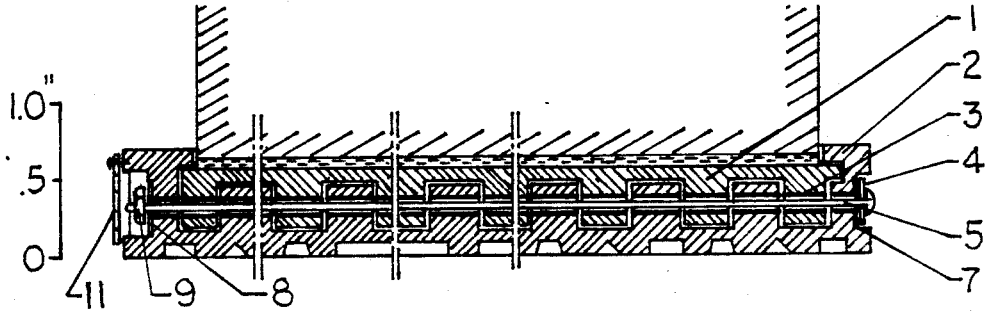
FIG. 9 is a fragmentary vertical cross section of shoe assembly, with shown segment of scale 1" length, to illustrate the proportions of assembly.
Figure 10:
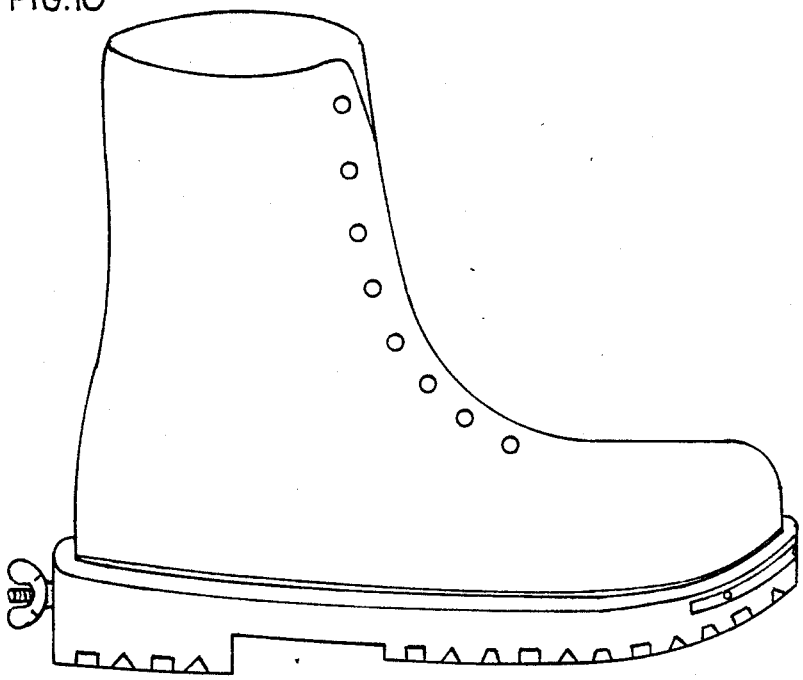
FIG. 10 is a pictorial sketch of a shoe of this invention.

Although bushings are placed into the treads of both soles, and outsole 2 has both upper and lower treads, once assembled, the whole sole assembly is no thicker than that of presently used soles for tourist, army or work shoes. To show proportions of the assembly, a segment of scale 1" length is shown in FIG. 9. The whole shoe is only slightly different from presently used shoes—as shown in FIG. 10.

The advantages of the present invention will be readily apparent to those skilled in the art.

While the embodiments of the present invention as herein disclosed constitute the preferred form thereof, many changes and modifications are possible without departing from the spirit and scope of this invention. For example, the set of connector rods can consist of more rods, more of the rods can go through the whole length of the sole, indentations and reinforcing elements can be different or omitted entirely, bushings might not be used but just holes by themselves, connector rods need not be fixed to the mounting plate but used individually, the lip to keep debris out may be omitted, air chambers can be left to reduce weight of shoe etc.

The following claims are intended to cover all variations, changes and/or modifications to the described embodiment of this invention.

I claim:

1. A shoe adapted to receive a removable outsole with a bottom tread such that the outsole can be changed depending on conditions of use, comprised of:
   - an upper portion of the shoe, designed to fit the foot of the user; and
   - an upper sole attached permanently to the bottom of the upper portion of the shoe, said uppersole having on it's bottom a tread with openings or bushings, the said openings or bushings are placed in straight lines for the length of the uppersole; and
   - an outsole that interlocks with said uppersole to form a full filled sole of said shoe, the outsole is comprised of:
   - an upper portion with such a tread that it fits into the spaces of the uppersole, said tread having openings or permanently mounted bushings, said openings or bushings placed in straight lines for the length of the outsole and in such a way that the openings or bushings of the uppersole and outsole together form a line or lines thru the whole length of the sole once the uppersole and outsole are interlocked; and
   - a middle portion; and
   - a bottom portion with a surface selected to provide good traction depending on conditions of use; and
   - a removable set of connector rods comprised of:
   - a mounting plate to which the connector rods are fixed on the same centerlines as the centerlines of said openings or bushings of the uppersole and outsole; and
   - one or more rods shaped to fit into the openings or bushings of said treads, where a minimum of one rod goes thru said openings, protrudes beyond the material of said soles and has a threaded end; and
   - a removable nut, which treaded on the end of the rod once the rod is installed into the assembled soles will prevent the said connector rod from falling out and secures the connection between said uppersole and said outsole or other similarly. connected outsoles.

2. A shoe of claim 1 wherein the tread of the uppersole does not cohere to all surfaces between tread of outsole, but air chambers are left between said uppersole and said outsole.

3. A shoe of claim 1 wherein the connector rods are not permanently fixed to the mounting plate and can be individually placed into the openings or bushings in the tread of uppersole of said shoe.

4. A shoe of claim 1 wherein a certain number of connector rods go through uppersole and outsole part of the length of the whole sole.

5. A shoe of claim 4 wherein the nut is permanently mounted in the material of any soles and the rod screws into the said nut.

* * * * *